United States Patent [19]

Fricker

[11] Patent Number: 4,650,101

[45] Date of Patent: Mar. 17, 1987

[54] SLIDING CLOSURE UNIT WITH EASILY REPLACEABLE LOWER STATIONARY REFRACTORY PLATE

[75] Inventor: Robert Fricker, Unterägeri, Switzerland

[73] Assignee: Stopinc Aktiengesellschaft, Baar, Switzerland

[21] Appl. No.: 842,804

[22] Filed: Mar. 21, 1986

[30] Foreign Application Priority Data

Apr. 10, 1985 [DE] Fed. Rep. of Germany ..... 3512799

[51] Int. Cl.[4] ..... B22D 41/10; F16K 3/18; C21C 5/48

[52] U.S. Cl. ..... 222/600; 222/512; 251/174; 266/271

[58] Field of Search ..... 222/600, 597, 594, 591, 222/561, 512, 598, 590, 606; 266/236, 271; 251/174; 137/316; 164/337, 437

[56] References Cited

U.S. PATENT DOCUMENTS 3,730,401 5/1973 Bode, Jr. ..... 222/512
4,545,512 10/1985 Shapland et al. ..... 222/600

FOREIGN PATENT DOCUMENTS 2219064 8/1973 Fed. Rep. of Germany .

*Primary Examiner*—H. Grant Skaggs
*Assistant Examiner*—Nils Pedersen
*Attorney, Agent, or Firm*—Wenderoth, Lind & Ponack

[57] ABSTRACT

A sliding closure unit includes an upper stationary refractory plate to be mounted on a metallurgical vessel, a movable refractory plate sealed against the upper stationary refractory plate, a slide unit for moving the movable refractory plate in a direction of movement between an open position with discharge openings in the movable refractory plate and the upper stationary refractory plate in alignment and a closed position with the discharge openings out of alignment, a lower stationary refractory plate mounted beneath the movable refractory plate, and tensioning devices for pressing the lower stationary refractory plate against the movable refractory plate. Guide members are provided for relieving the pressure of the tensioning devices on the lower stationary refractory plate upon movement of the movable refractory plate to the closed position, thereby enabling replacement of the lower stationary refractory plate. The guide members are provided on the slide unit and extend in the direction of movement.

6 Claims, 3 Drawing Figures

SLIDING CLOSURE UNIT WITH EASILY REPLACEABLE LOWER STATIONARY REFRACTORY PLATE

BACKGROUND OF THE INVENTION

The present invention relates to an improved sliding closure unit having an easily replaceable lower stationary refractory plate. More particularly, the present invention is directed to an improved sliding closure unit for controlling the discharge of molten metal from a metallurgical vessel and being of the type including an upper or bottom stationary refractory plate to be mounted on the metallurgical vessel with a discharge opening aligned with a discharge nozzle of the metallurgical vessel, a movable refractory plate urged into sealing contact against the upper stationary refractory plate and having a discharge opening, sliding means for moving the movable refractory plate in a direction of movement between an open position with the discharge openings of the movable refractory plate and the upper stationary refractory plate in alignment and a closed position with the discharge openings out of alignment, a lower or locking stationary refractory plate mounted beneath the movable refractory plate, and tensioning means for pressing the lower stationary refractory plate against the movable refractory plate. The lower stationary refractory plate preferably has mounted thereon a refractory pouring tube.

A sliding closure unit of this general type is disclosed in DE-OS No. 22 19 064 and includes sliding means, movable back and forth in a direction of movement by a pressure cylinder, comprising an impact member connected to a piston rod of the pressure cylinder. Traction rods are attached to the impact member and extend laterally along the movable refractory plate. A traction member is attached to ends of the traction rods and connects the rods. When a movable refractory plate is to be replaced, a new movable refractory plate is positioned between the movable refractory plate already in use and the extended traction member and then thrust by the pressure cylinder via the traction member into the position of the worn plate previously in use. This newly positioned movable refractory plate is pressed against a bottom or upper stationary refractory plate by spring-loaded levers which are laterally positioned and which pivot about fixed axes. A holding or lower stationary refractory plate, having the refractory pouring tube connected thereto, likewise is pressed against the movable refractory plate by rocker or pivotally mounted levers. When the lower stationary refractory plate, together with the refractory pouring tube, is to be replaced, a new unit is positioned between the extended traction member and the lower stationary refractory plate already in use, in a manner similar to that described above regarding replacement of the movable refractory plate. This new lower stationary refractory plate is pressed against the used lower stationary refractory plate by the traction member by actuating the pressure cylinder until the new lower stationary refractory plate assumes the position of the previously used one.

However, a disadvantage of this type of replacement system is the fact that the refractory pouring tube and the locking or lower stationary refractory plate can be replaced only by operation of the pressure cylinder. Furthermore, this arrangement requires special holding structures for receiving and moving the lower stationary refractory plate, as well as detachable blocking structures to prevent unintended shifting thereof.

SUMMARY OF THE INVENTION

Accordingly, it is an object of the present invention to provide an improved sliding closure unit structure including an easily replaceable lower stationary refractory plate, whereby it is possible to overcome the above and other prior art disadvantages.

It is a more specific object of the present invention to provide such an improved sliding closure unit whereby the locking or lower stationary refractory plate, preferably having connected thereto a refractory pouring tube, can be rapidly and easily replaced without requiring operation of the pressure cylinder for the actual replacement operation.

These objects of the present invention are achieved in accordance with the present invention by the provision of means for relieving the pressure of the tensioning means on the lower stationary refractory plate upon movement of the movable refractory plate to the closed position thereof, thereby enabling easy and rapid replacement of the lower stationary refractory plate when the sliding closure unit is closed, such replacement operation itself not requiring any direct action by the sliding means which moves the movable refractory plate to the closed position. Such relieving means comprises guide means, on the sliding means and extending in the direction of movement, for acting against the tensioning means upon operation of the sliding means to move the movable refractory plate to the closed position. Such guide means is operable directly or indirectly against the tensioning means. As a result of this arrangement, movement of the movable refractory plate to the closed position thereof automatically frees the lower stationary refractory plate from the action of the tensioning means, whereby the lower stationary refractory plate, and the refractory pouring tube connected thereto, can be removed easily for servicing or replacement, by simple operations without requiring special structures or equipment.

In accordance with a preferred arrangement of the present invention, the guide means comprise longitudinal grooves having respective depths which decrease in the direction of movement, such grooves preferably being formed in longitudinal members held in the frame of the sliding means. The relieving means further comprises guide members having a portion extending into a repective longitudinal groove and another portion abutting a spring-biased pivotal lever which forms the tensioning means. Thus, movement of the sliding means in the direction of movement causes the guide members to move the respective levers against the spring-biased force.

In accordance with a further specific arrangement of the present invention, at least three levers are pivotally mounted about a fixed axis on each of opposite sides of the lower stationary refractory plate, each axis extends parallel to the direction of movement, and each lever extends transverse to the direction of movement. Each lever has a first end acted on by a spring and a second end urged toward the lower stationary refractory plate by the spring. A center lever of each group of three levers has at the second end thereof an upper abutment surface abutted by a respective guide member and a lower stop surface for pressing against upper stop surfaces of second ends of opposite lateral levers of each group of three levers. Preferably, the lower stop surface of the center lever is spaced from the upper stop surfaces of the lateral levers when the movable refractory plate is in the open position thereof, whereby there is play between the lower and upper stop surfaces. Thus, in this arrangement, it is possible to reduce space requirements by providing that the guide member acts only on a center lever, with such center lever then acting on the opposite lateral levers.

In accordance with a modified arrangement of the present invention, the guide means are in the form of longitudinal ribs extending in the direction of movement and having increased length portions acting directly on the tensioning means when the sliding means moves the movable refractory plate to the closed position.

BRIEF DESCRIPTION OF THE DRAWINGS

Other objects, features and advantages of the present invention will be apparent from the following detailed description of preferred embodiments thereof, with reference to the accompanying drawings, wherein.

DETAILED DESCRIPTION OF THE INVENTION

Figure 1:
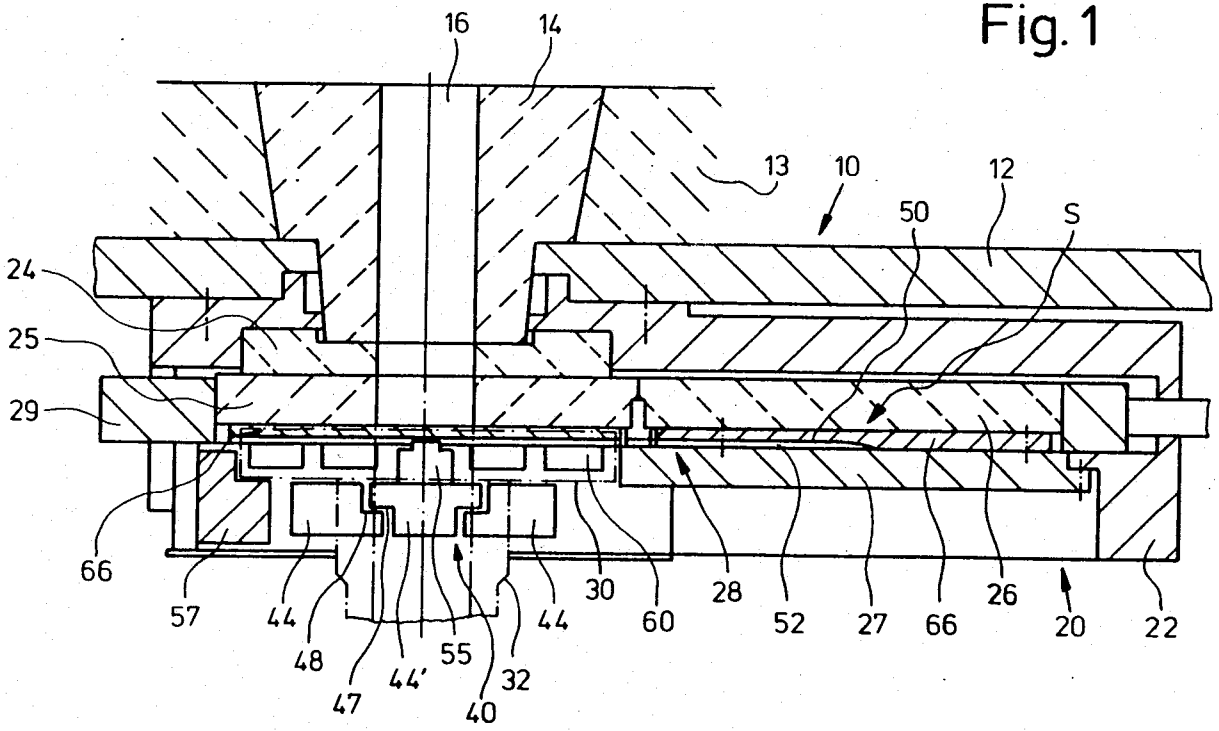
FIG. 1 is a longitudinal section, shown somewhat schematically, of a sliding closure unit in accordance with a first embodiment of the present invention and connected to a metallurgical vessel.

In FIG. 1 there is shown a portion of the outlet area of the bottom of a metallurgical vessel 10 including a metal jacket 12, a refractory lining 13, and a discharge nozzle brick 14 extending through refractory lining 13 and having a discharge passage 16. A sliding closure unit 20 includes a stationary housing 22 fixed to metal jacket 12 and supporting a bottom refractory plate or upper stationary refractory plate 24 having therethrough a discharge opening aligned with discharge passage 16. Slidably movable within housing 22 is a slide unit 28 including a frame 29 supporting a movable refractory plate which, in the illustration of FIG. 1, includes a discharge plate portion 25 and a closing plate portion 26. The slide unit 28 is movable from an open position shown in FIG. 1 whereat a discharge opening of the movable refractory plate is aligned with the discharge opening of upper stationary refractory plate 24, and a closed position whereat such discharge openings are out of alignment and whereat the discharge opening through stationary refractory plate 24 is closed by movable plate portion 26. Thus, the slide unit 28 moves in a direction of movement to the left with respect to FIG. 1 between the open position shown therein and a closed position whereat the discharge opening of stationary refractory plate 24 is closed by movable refractory plate portion 26.

Figure 2:
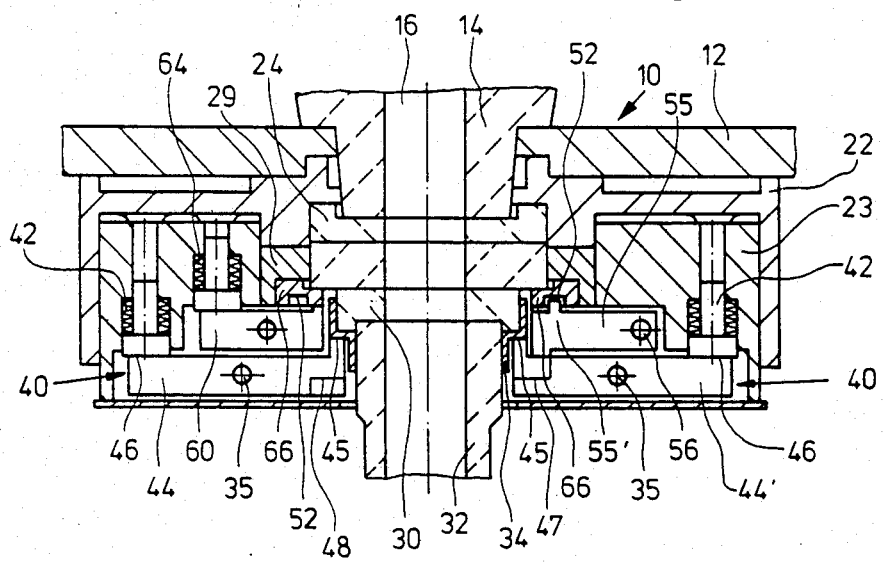
FIG. 2 is a transverse section thereof.

As shown in FIG. 2, the movable refractory plate, including plate portions 25 or 26, is moved upwardly into sealing contact with the stationary refractory plate 24 by pivotally mounting rocking levers 60 which are tensioned by springs 64, such elements being mounted in replaceable portions 23 connected to housing 22. It will be apparent that when the slide unit moves the movable refractory plate to the closed position, i.e. to the left with respect to the illustration of FIG. 1, then the movable plate portion 25 will be located outwardly of the unit and thereat may be replaced. On the other hand, it will be apparent from a consideration of FIG. 1 that when the movable refractory plate is in the open position shown in FIG. 1, then the plate portion 26 easily can be replaced from below simply by removing cover 27 from housing 22. It will be understood by those skilled in the art that plate portion 26 requires replacement less often than plate portion 25.

The sliding closure unit further includes a lower or locking refractory plate 30 having connected thereto a refractory pouring tube 32, such elements being mortared in a metal shell 34 and sealingly pressed by tension elements 40 against the movable refractory plate, i.e. against either plate portion 25 or plate portion 26, whichever is positioned beneath discharge passage 16. Hereinafter the refractory plate 30 is referred to as a lower "stationary" refractory plate, but this terminology is employed to indicate that plate 30 is not slidable. Plate 30 is however urged upwardly by tensioning devices 40. Tension devices 40 include springs 42 and levers 44, 44' pivotally mounted about stationary axles 35. Springs 42 act on outer ends 46 of levers 44, 44' to pivot the levers about axle 35 such that inner ends 45 of the levers urge lower stationary refractory plate 30 upwardly into sealing contact against plate portions 25 or 26.

In accordance with the present invention, there is provided structure for acting against the tensioning devices 40 upon operation of the slide unit 28 to move the movable refractory plate from the open position shown in FIG. 1 to the closed position. Thus, connected to frame 29 on opposite sides of the unit are longitudinal strip members 66 which move with frame 29. Guide means 50 id formed by longitudinal grooves 52 in each member 66, such grooves extending in the direction of movement. As shown in FIG. 1, the depth of each groove 52 decreases in the direction of movement, i.e. such that when the slide unit moves the movable refractory plate to the closed position, the surface defining groove 52 has a shallower depth. On each side of the plate 30 is fixedly mounted a guide member 55 for pivotal movement about an axle 56. An upper or guide portion 55' of an inner end of guide member 55 fits within a respective groove 52. A lower side of the inner end of guide member 55 abuts an upper abutment surface of a central lever 44' of a group of at least three levers on each side of plate 30. This relationship particularly is shown in FIG. 1. Lever 44' has lower stop surfaces 47 which press against upper stop surfaces 48 of each of the levers 44 located laterally of lever 44'. As will be apparent from a consideration of FIGS. 1 and 2, when the slide unit moves the removably refractory plate to the closed position, the reduced depth contour of grooves 52 will press portions 55' downwardly, and this movement will be transmitted to central levers 44' on each side of plate 30. Surfaces 47 of central levers 44' then will act on surfaces 48 of lateral levers 44, with the result that all three levers on each side of plate 30 will be pressed downwardly against the force of springs 42, thereby relieving the pressure acting to press plate 30 against plate portion 26. This relieving action however will occur only when the movable refractory plate is moved to the closed position thereof. When in this relieved condition, then simply by removal of stop 57 at the front of plate 30, plate 30 easily and rapidly can be removed and repaired or replaced. Thereafter, when the slide unit again moves the movable sliding plate to the open position, the tensioning devices 40 again automatically will press plate 30 upwardly into sealing contact with the movable refractory plate.

It is to be understood that plate 30 is positioned in the direction of movement by stop 57 and by cover 27. Further, the left side of the section of FIG. 2 is shown along a plane behind guide member 55, such that one of the levers 60 is shown, whereas the right side of the section of FIG. 2 is shown in front of guide member 55. Additionally, as will be apparent from FIG. 1, when the movable refractory plate is in the open position, there is space between stop surfaces 47 and 48. This play makes it possible for levers 44, 44' to adapt independently of each other to any irregularities in the dimensions or bearing surface of plate 30. Furthermore, it is to be understood that each guide member 55 could be constructed so that it rests on all three levers 44, 44' and presses directly on them, rather than acting only on the central lever 44' as shown.

Figure 3:
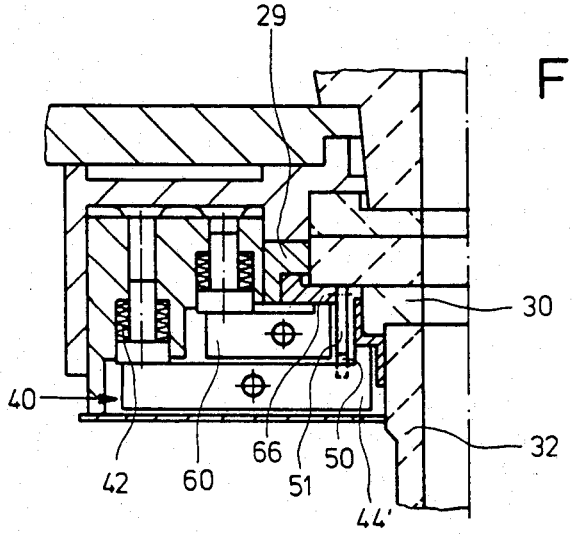
FIG. 3 is a partial view similar to FIG. 2 but of a second embodiment of the present invention.

In the above embodiment of the present invention, the guide means 50 are operable indirectly on the tensioning devices 40. However, in the embodiment of FIG. 3 the guide means 50 are in the form of longitudinal ribs 51 fixed to and extending downwardly from respective members 66 and having portions, for example curved or inclined surfaces, which bear directly on respective lever 44' (or all of levers 44, 44') when the slide unit moves in the direction of movement to a position such that the movable refractory plate is in the closed position.

Although the present invention has been described and illustrated with respect to preferred features thereof, it is to be understood that various changes and modifications may be made to the specifically described and illustrated features without departing from the scope of the present invention.

I claim:

1. In a sliding closure unit for controlling the discharge of molten metal from a metallurgical vessel and of the type including an upper stationary refractory plate to be mounted on the metallurgical vessel with a discharge opening aligned with a discharge nozzle of the metallurgical vessel, a movable refractory plate sealed against said upper stationary refractory plate and having a discharge opening, sliding means for moving said movable refractory plate in a direction of movement between an open position with said discharge openings of said movable refractory plate and said upper stationary refractory plate in alignment and a closed position with said discharge openings out of alignment, a lower stationary refractory plate mounted beneath said movable refractory plate, and tensioning means for pressing said lower stationary refractory plate against said movable refractory plate, the improvement comprising means for relieving the pressure of said tensioning means on said lower stationary refractory plate upon movement of said movable refractory plate to said closed position, and thereby for enabling replacement of said lower stationary refractory plate, said relieving means comprising:

guide means, on said sliding means and extending in said direction of movement, for acting against said tensioning means upon operation of said sliding means to move said movable refractory plate to said closed position.

2. The improvement claimed in claim 1, wherein said tensioning means comprise pivotally mounted levers and springs acting on said levers to pivot said levers to press said lower stationary refractory plate toward said movable refractory plate, and said guide means comprise longitudinal grooves having respective depths which decrease in said direction of movement, and said relieving means further comprises guide members, each said guide member having a first portion extending into a respective said longitudinal groove and a second portion abutting a respective said lever, such that movement of said sliding means in said direction of movement causes said guide members to move said respective levers against the force of said springs.

3. The improvement claimed in claim 2, wherein said sliding means comprises a movable frame supporting said movable refractory plate, and longitudinal members mounted on said movable frame and movable therewith in said direction of movement, and said longitudinal grooves are formed in said longitudinal members.

4. The improvement claimed in claim 2, comprising at least three said levers pivotally mounted about a fixed axis on each of opposite sides of said lower stationary refractory plate, each said axis extending parallel to said direction of movement, each said lever extending transverse to said direction of movement, each said lever having a first end acted on by a said spring and a second end urged toward said lower stationary refractory plate by said spring, and a center said lever of said three levers having at said second end thereof an upper abutment surface abutted by said second portion of a respective said guide member and alower stop surface for pressing against upper stop surfaces of second ends of opposite lateral said levers of said three levers.

5. The improvement claimed in claim 4, wherein said lower stop surface of said center lever is spaced from said upper stop surfaces of said lateral levers when said movable refractory plate is in said open position thereof.

6. The improvement claimed in claim 1, wherein said guide means comprise longitudinal ribs extending in said direction of movement and having portions acting directly on said tensioning means when said sliding means moves said movable refractory plate to said closed position.

* * * * *